United States Patent [19]

Bogdanov

[11] Patent Number: 4,907,752

[45] Date of Patent: Mar. 13, 1990

[54] BALL-TUBE MILL

[75] Inventor: Vasily S. Bogdanov, Belgorod, U.S.S.R.

[73] Assignee: Materialov Imeni I.A. Grishmanova. Belgorodsky Tekhnologichesky Institut Stroielnykh, Belgorod, U.S.S.R.

[21] Appl. No.: 183,771

[22] Filed: Apr. 20, 1988

[51] Int. Cl.[4] ..... B02C 17/06

[52] U.S. Cl. ..... 241/171; 241/176; 241/182

[58] Field of Search ..... 241/182, 180, 179, 176, 241/171

[56] References Cited

U.S. PATENT DOCUMENTS

| | | | |
|---|---|---|---|
| 1,787,897 | 1/1931 | Durnin | 241/182 X |
| 3,212,722 | 10/1965 | Heinz-Jochemmaeder et al. | 241/171 |

FOREIGN PATENT DOCUMENTS

| | | | |
|---|---|---|---|
| 692622 | 10/1979 | U.S.S.R. | 241/182 |
| 733727 | 5/1980 | U.S.S.R. | 241/182 |
| 761000 | 9/1980 | U.S.S.R. | 241/182 |
| 795560 | 1/1981 | U.S.S.R. | 241/182 |
| 886978 | 12/1981 | U.S.S.R. . | |
| 1080861 | 3/1984 | U.S.S.R. | 241/182 |

*Primary Examiner*—Joseph M. Gorski

*Attorney, Agent, or Firm*—Lilling & Greenspan

[57] ABSTRACT

A ball-tube mill includes a rotatable drum enclosed at the opposite sides by bottoms having a charging port and a discharge port, the drum accommodating an even number of perforated walls having the form of an ellipse, arranged at an angle to the centerline of the drum, and offset along the like axes of the ellipse one relative to another to define milling chambers occupied by grinding bodies. The bottoms are inclined to the longitudinal centerline of the drum at an inclination angle equal to the angle of inclination of the perforated walls, each bottom and one of the perforated walls being inclined in pairs to the opposite directions, the bottoms and the perforated walls being successively offset along the like axes of the ellipse one relative to the other at an angle $\beta = 360°:n$, where n is the total number of bottoms and perforated walls.

1 Claim, 2 Drawing Sheets

BALL-TUBE MILL

BACKGROUND OF THE INVENTION

1. Field of the Invention

This invention relates generally to the art of comminuting materials, and more particularly to ball-tube mills.

2. Description of the Prior Art

There is known a ball-tube mill comprising a lined drum journalled by its trunnions in bearings and kinematically linked with a rotation drive. The lined drum is enclosed at the opposite ends by bottoms having the form of truncated cones. One bottom of the drum has a charging port, whereas the other bottom has a discharge port. The interior of the drum accommodates two perforated walls arranged at an angle to the longitudinal centerline of the drum and defining milling chambers occupied by grinding bodies. The perforated walls have the form of an ellipse and are offset inside the drum along the like axes (SU, A, 886,978).

Vigorous comminution of the material occurs only in the middle chamber of the above mill. Such comminution takes place due to that the envigorating action of the inclined wall extends to a limited length along the drum depending on the angle of inclination of the wall, mass of the grinding bodies, and the natural slope angle of these grinding bodies. In the middle chamber the areas of vigorous action of the inclined walls on the grinding bodies are superposed to result in the maximum grinding efficiency. The material is ground through the length of the middle chamber by virtue of vigorous lengthwise and crosswise movement of the grinding bodies. No stagnation zones are formed lengthwise and across the charge.

The envigorating action of the inclined walls does not extend to the drum portions adjacent the bottoms in the end chambers of the mill. The material is ground only due to the movement of the grinding bodies across the drum. In the cross-section of the portions of the drum adjacent the bottoms the grinding bodies and the material being ground are subject to stagnation, thus reducing the efficiency of the grinding process.

The rate of grinding in the chambers of the above mill is non-uniform, viz., it is slower in the end chambers than in the middle chamber. This in turn results in a non-uniform grinding process.

As the particles of the material being ground are reduced in size, the amount of energy required for carrying out the grinding operation grows, viz., in the first chamber where coarse grinding takes place it is minimal, whereas in the last chamber of fine grinding it is maximal. Accordingly, the first chamber fails to deliver sufficient amounts of the material being ground to the second chamber capable of handling a greater quantity of material due to the vigorous action of the grinding bodies. In contrast, the third chamber of the minimal grinding efficiency is overcrowded with the material delivered from the second chamber. In consequence, this reduces the overall grinding efficiency.

Vigorous lengthwise and crosswise movement of the grinding bodies in the middle chamber and in the portions of the drum of the end chambers adjacent the inclined walls gives rise to unbalanced longitudinal forces acting to prematurely wear the trunnions and bearings to result in affected reliability of this prior art mill in general.

SUMMARY OF THE INVENTION

It is an object of the present invention to increase the grinding efficiency, make grinding of the material more uniform through the length of the lined drum, and simultaneously reduce axial loads exerted on bearings.

These and other objects of the invention are attained by a ball-tube mill comprising a rotable lined drum enclosed at the opposite sides by bottoms having charging and discharging ports, the drum accommodating an even number of perforated walls having the form of an ellipse, arranged at an angle to the centerline of the drum, and offset along the like axes of the ellipse one relative to another to define milling chambers occupied by grinding bodies. According to the invention, the bottoms are inclined to the longitudinal centerline of the drum at an inclination angle equal to the angle of inclination of the perforated walls, each bottom and one of the perforated walls being inclined in pairs to the opposite directions, the bottoms and the perforated walls being successively offset along the like axes of the ellipse one relative to the other at an angle $\beta = 360°: n$, where n is the total number of bottoms and perforated walls.

The ball-tube mill according to the invention, while being relatively simple structurally, provides the maximum efficiency and uniformity of grinding in each of the milling chambers, ensures end product of high quality, and features long service life of trunnions and bearings.

BRIEF DESCRIPTION OF THE DRAWINGS

The invention will now be described in greater detail will reference to a specific embodiment thereof taken in conjunction with the accompanying drawings, in which.

DESCRIPTION OF THE PREFERRED EMBODIMENT

Figure 1:
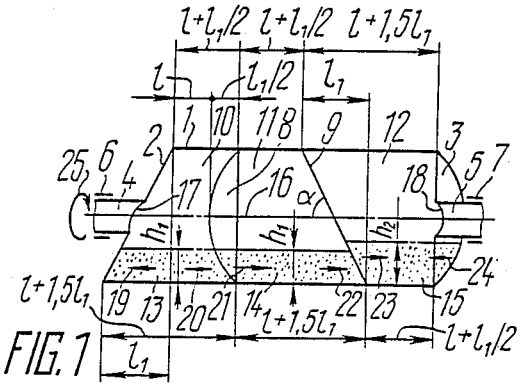
FIG. 1 is a longitudinal sectional view of the ball-tube mill according to the invention.

A ball-tube mill comprises a lined cylindrical drum 1 (FIG. 1), hereinafter referred to as drum 1, enclosed at the opposite ends by bottoms 2 and 3. Trunnions 4 and 5 of the drum 1 are carried by bearings 6 and 7, whereas the drum 1 per se is kinematically linked with a rotation drive (not shown).

The interior of the drum 1 has two perforated walls 8 and 9 spaced from each other and defining milling chambers 10, 11, 12 occupied by grinding bodies 13, 14 and 15, respectively. The walls 8 and 9 are arranged at an angle $\alpha$ to the longitudinal centerline of the drum 16.

The bottoms 2 and 3 are also inclined to the longitudinal centerline 16 of the drum 1 at an angle $\alpha$ equal to the inclination angle of the walls 8 and 9 to the longitudinal centerline 16, and have the form of ellipses.

The bottom 2 and wall 9 forming a pair are inclined at the same angle $\alpha$ to the longitudinal centerline 16, although in the opposite directions. The bottom 3 and wall 8 likewise form a pair, and are also inclined at the same angle $\alpha$ to the centerline 16 in the opposite directions.

Figure 2:
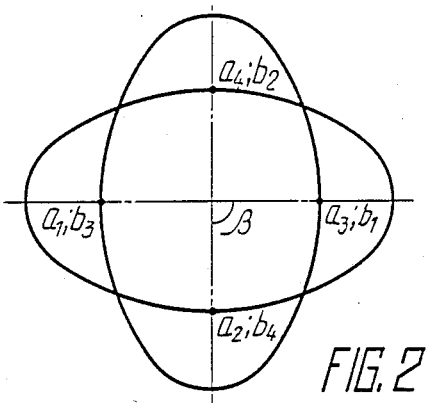
FIG. 2 shows mutual positioning of minor axes of the ellipses, bottoms and perforated walls in the position of the lined drum illustrated in FIG. 1.

The bottoms 2, 3 and walls 8, 9 are successively offset relative to each other along the like axes of the ellipse at an angle $\beta$ equal to 360°: n, where n is the total number of bottoms and walls. In the example herein described $n=4$, $\beta=90°$, as shown in FIG. 2: $a_1b_1$ is the position of the minor axis of the ellipse of the bottom 2; $a_2b_2$ is the position of the minor axis of the ellipse of the wall 8 offset relative to the minor axis $a_1b_1$ of the ellipse of the bottom 2 at an angle $\beta$ equal to 90°; $a_3b_3$ is the position of the minor axis of the ellipse of the wall 9 offset relative to the minor axis $a_2b_2$ of the ellipse of the wall 8 at an angle of 90°; $a_4b_4$ is the position of the minor axis of the ellipse of the bottom 3 offset relative to the minor axis $a_3b_3$ of the ellipse of the wall 9 at an angle of 90°.

The bottom 2 has a charging port 17, whereas the bottom 3 has a discharge port 18.

In the example herein discussed the walls 8 and 9 define milling chambers 10, 11 and 12 of equal volumes.

Each of the milling chambers 10, 11 and 12 are charged with grinding bodies 13, 14 and 15 of equal mass. The first chamber 10 is charged with grinding bodies 13 having a diameter substantially greater than the diameter of the grinding bodies 14 charged to the chamber 11. The grinding bodies 15 charged to the chamber 12 are of the smallest diameter.

With reference to the position of the drum 1 represented in FIG. 1, the length of the lower portion of the chamber 10 is $l+1.5l$, where l is the projection of the extreme points of the bottom and corresponding wall onto the generating line of the drum 1; and $l_1$ is the projection of the bottoms and walls onto the same generating line.

The length of the upper portion of the chamber 10 is $l+l_1/2$, and that of the lower portion of the chamber 11 is $l+1.5l$ whereas the length of the upper portion of the chamber 11 is $l+l_1/2$. The length of the lower portion of the chamber 12 is $l+l_1/2$, and that of the upper portion is $l+1.5l_1$.

The length of each of the chambers 10, 11, 12 varies along the generating line of the drum 1 in one revolution thereof from the minimal length l to the maximal length $l+1.5l_1$.

The ball-tube mill according to the invention operates as follows.

In the initial position of the drum 1 shown in FIG. 1 the lower or working portion of each of the chambers 10 and 11 are of the maximum (for the example being considered) length equal to $l+1.5l_1$. The level $h_1$ of the grinding bodies and the material being ground, to be hereinafter referred to as a charge, in each of the chambers 10 and 11 are equal in terms of height, and are the minimum possible for the example being discussed.

The length of the working portion of the chamber 12 is minimal, equalling $l+l_1/2$. Because each of the chambers 10, 11 and 12 are charged with the grinding bodies 13, 14, 15 of equal mass, the level of charge in the chamber 12 in the position illustrated in FIG. 1 is higher than in the chambers 10 and 12 to be characterized by the height $h_2$, which is greater than $h_1(h_2>h_1)$, $h_1$ being the level of charge at this point in time in the chambers 10, 11.

Figure 3:
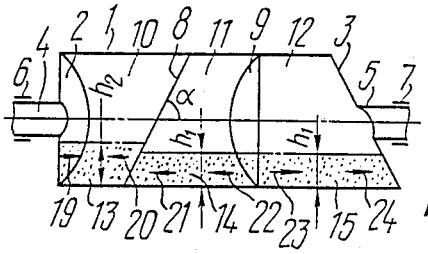
FIGS. 3, 4 and 5 represent positions of the bottoms, perforated walls, and grinding bodies during successive turning of the drum at 90°.
Figure 4:
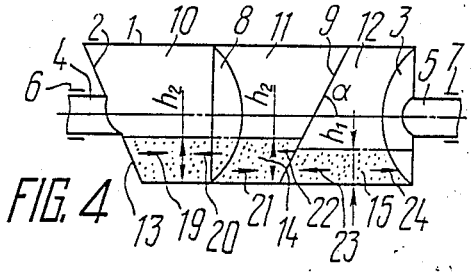
Figure 5:
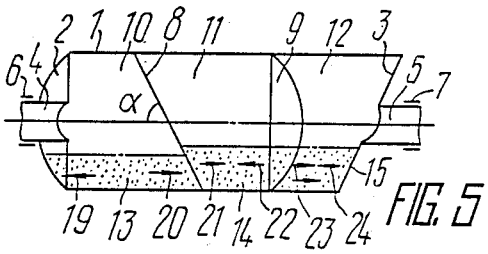

In the course of operation of the proposed mill the drum 1 rotates in the direction indicated by the arrow 25, and assumes positions illustrated in FIGS. 3, 4, and 5.

When the drum 1 turns 90° relative to the position illustrated in FIG. 1, the length of the working portion of the chamber 10 (FIG. 3) becomes minimal, viz., equal to $l+l_1/2$. The level of charge in the chamber 10 increases to the maximum possible to equal $h_2$. The length of the working portion of the chamber 11 remains invariable, as is the level $h_1$ of charge therein. However, the grinding bodies 14 tend to move lengthwise of the chamber 11. This is accounted for by a change in the position (direction of inclination) of the perforated walls 8,9 relative to the generating lines of the drum 1 in the position under discussion ensured by the displacement of the minor axes of the ellipses of the perforated walls at an angle $\beta=360$: n. The length of the working portion of the chamber 12 (FIG. 3) has grown by $l_1$ to become maximum possible (in the example under discussion) $l+1.5l_1$. The level of charge in the chamber 12 has reduced to the minimal equal to $h_1$. Therewith, the levels of charge in the chambers 11 and 12 are equal in terms of height due to the equal lengths of the working portion of each of the chambers 11 and 12 and equal mass of the grinding bodies 14 and 15 present in these chambers. As the drum 1 turns 90° to the position shown in FIG. 3, the bottom 2 acts to move the mass of charge to the direction indicated by the arrow 19; the perforated wall 8 acts to move the same amount of charge in the opposite direction indicated by the arrow 20. Therewith, the longitudinal forces resulting from the movement of the charge by the bottom 2 and perforated wall 8 in the chamber 10 are equal in magnitude and opposite in direction, whereby the resultant force is zero. At the same time, the perforated wall 9 in the chambers 11 and 12 move equal masses of charge in the opposite directions illustrated by the arrows 22 and 23. In consequence, the resultant of the longitudinal forces from the movement of the charge by the perforated wall 9 in the chambers 11 and 12 is also zero. And finally, in the chamber 12 the charge is moved to under the bottom 3 in a direction indicated by 24, the same amount of charge being moved in the chamber 11 along the wall 8 in the opposite direction indicated at 21, which equalizes the axial force resulting from the lengthwise movement of the grinding bodies in the chambers 12 and 11. Their resultant force is also zero.

Therefore, as the drum 1 turns 90° to change its position from the one shown in FIG. 1 to one represented in FIG. 3, the longitudinal forces are equal to (or close to) zero, whereby no axial loads are exerted on the bearings.

A subsequent turning of the drum 1 at 90° results in that it assumes a position illustrated in FIG. 4. The length of the working portion of the chambers 10 and 11 equals to the minimum possible, viz., in this position $l+l_1/2$, and the level of charge in these chambers grows to the maximum possible, viz. $h_2$.

The length of the working portion of the chamber 12 and the level of charge therein remain invariable to equal $l+1.5l_1$ and $h_1$, respectively. This, however, is accompanied by a change in the position of the perforated wall 9 and bottom 3, as compared with the preceding position (FIG. 3), which gives rise to the lengthwise movement of the charge to eliminate stagnation zones and intensify the grinding process. In the chamber 10 the charge of equal mass is moved by the bottom 2 and wall 8 in the mutually counter directions indicated by 19 and 20. In the chamber 11 the charge of equal mass is moved by the walls 8 and 9 also in the mutually counter directions indicated by 21 and 22. And finally in the chamber 12 the charge of equal mass is moved to under the wall 9 in the direction indicated at 23, and in the opposite direction indicated by 24 toward the bottom 3. Accordingly, in this position of the drum 1 the resultant of the longitudinal forces is zero, and no axial loads are exerted on the bearings 6 and 7.

A further rotation of the drum 1 at 90° results in that it assumes a position represented in FIG. 5. Here, the length of the working portion of the chamber 10 grows to the maximum, viz. $l+1.5l_1$, and the level of charge therein equals $h_1$. The length of the working portion of the chamber 11 and the level of charge therein remain invariable as compared with the previous position (FIG. 4). Accordingly, the position of the walls 8 and 9, and the profile of the chamber 11, as compared with that illustrated in FIG. 3, change to result in the lengthwise movement of the charge and intensified grinding process. The length of the working portion of the chamber 12 is reduced to the minimum, viz. $l+l_1/2$, whereas the level of charge in this chamber grows to the maximum $h_2$. The levels of charge and the lengths of the working portions of the chambers 11 and 12 are equal. Axial loads in the chamber 10 are balanced by the oppositely directed movement of the equal masses of charge in the direction 19 toward the bottom 2 and direction 20 to under the wall 8. In the chamber 11 the axial loads are balanced by the movement of equal masses of charge in the mutually counter directions 21 and 22 away from the walls 8 and 9. Axial loads resulting from the lengthwise travel of charge in the chamber 11 are also zero. In a likewise fashion, the axial loads in the chamber 12 are balanced by the mutually counter movement of the equal masses of charge in the directions 23 and 24 from the wall 9 and bottom 3, respectively. In consequence, in the position shown in FIG. 5 the axial loads resulting from the lengthwise movement of the grinding bodies (charge) in each of the chambers of the mill are mutually balanced, whereas their resultant force is zero. No axial forces are exerted on the bearings 6 and 7.

In the further rotation of the drum 1 at 90° it returns to the initial position represented in FIG. 1. The length of the chambers 10 and 11 is maximal. The level of charge in these chambers is minimal. In the chambers 10 and 11 the zero axial force resulting from the lengthwise movement of the charge is ensured by the movement of the equal amounts of charge in the opposite directions indicated at 19, 22 and 20, 21. The length of the working portion of the chamber 12 and the level of charge therein remain invariable. However, inclination of the ends of the chamber 12 defined by the wall 9 and bottom 3 changes to result in the lengthwise movement of the equal volumes of charge in the mutually counter directions 23 and 24 from the wall 9 and bottom 3, respectively. The resultant of the axial force is therefore zero in this position. Accordingly, in one full cycle (i.e., in one revolution of the drum) the axial loads exerted on the bearings 6 and 7 are zero.

The absence of axial loads on the bearings 6 and 7 during the lengthwise travel of the grinding bodies 13, 14 and 15 in the drum 1 of the proposed ball-tube mill is ensured by the mutual balancing of forces exerted either in the counter or in the opposite directions in each of the chambers 10, 11 and 12 along the arrows 19 to 24, and is attained because the bottoms 2, 3 and walls 8, 9 are inclined in pairs in the opposite directions.

During the subsequent rotation of the drum the cycles of the charge movement are repeated.

In view of the foregoing, in any position of the drum 1 provided with inclined walls 8 and 9 in the case, when the bottoms 2 and 3 thereof are arranged at the same angle $\alpha$ to the longitudinal centerline of the drum 1 as the walls 8 and 9, and when the bottoms 2 and 3 and the walls 8 and 9 are offset relative to each other along the minor ellipse axes at an angle $\beta=360$: n and inclined in pairs to the opposite sides, the axial loads on bearings 6 and 7 are absent. This in turn results in a longer service life of the trunnions 4, 5 and bearings 6, 7, and improves operational reliability of the proposed ball-tube mill in general.

Rotation of the drum 1 causes the grinding bodies 13, 14 and 15 in each of the chambers 10, 11 and 12, respectively, to rise under the action of centrifugal forces across the drum to execute during falling down impact grinding and be reciprocated by the bottoms 2, 3 and walls 8, 9 along the centerline 16 of the drum 1 thus grinding by vigorous attrition.

In the known ball-tube mill (in the prototype mill) stagnation zones tend to be formed in the space adjacent the bottoms, where the grinding bodies move only across the centerline under the action of centrifugal forces.

In the ball-tube mill according to the invention the arrangement of the bottoms 2 and 3 at the angle $\alpha$ to the centerline 16 causes the grinding bodies 13, 14, 15 to uniformly reciprocate along the centerline 16 of the drum 1 through the entire volume of charge in each of the chambers 10, 11 and 12. This results in elimination of stagnation zones and more efficient grinding process.

The grinding bodies in each of the chambers 10, 11, 12 of the mill have equal energy, because their geometry and the kinetics of movement of the grinding bodies are similar. Therefore, more favourable conditions for the grinding process are provided in each chamber to improve the quality of the end product.

Since the length of the working portion of each of the chambers 10, 11, 12 of the proposed mill changes to a greater magnitude than that in the prototype mill, the longitudinal travel of the grinding bodies 13, 14, 15 is envigorated to result in a more efficient grinding by attrition.

In the zones adjacent the bottoms 2, 3 and walls 8, 9 the grinding bodies are raised to a greater height to fall at an angle of 85°-90°. Thereby, the proposed mill imparts a greater potential energy to the grinding bodies (as compared with the prototype mill) to ensure a more efficient grinding process.

The invention can find application in the cement making industry, in mining, and for other industrial uses, where fine grinding of materials is essential.

What is claimed is:

1. A ball-tube mill comprising:

a lined rotatable drum having a longitudinal axis;

a first bottom fixedly mounted on said lined drum for rotation therewith and closing said lined drum at the side of feeding a material being comminuted and inclined with respect to the longitudinal axis of said lined drum and having the form of an ellipse;

a second bottom fixedly mounted on said lined drum for rotation therewith and closing said lined drum at the side of discharging the comminuted material and positioned at an angle to the longitudinal axis of said lined drum and having the form of an ellipse;

two perforated walls fixedly mounted on said lined drum for rotation therewith, each perforated wall having the form of an ellipse and being inclined with respect to the longitudinal axis of said lined drum and angularly offset one with respect to the other about the longitudinal axis by a predetermined amount wherein the first of these two perforated walls is turned in the direction of rotation of said lined drum a predetermined angle with respect to the larger axis of the ellipse of said first bottom, while the second one of the two said perforated walls is turned in the direction of rotation of said lined drum at said predetermined angle with respect to the larger axis of the ellipse of said first perforated wall, while said second bottom is turned in the direction of rotation of said lined drum with respect to the larger axis of the ellipse of said second perforated wall at said predetermined angle, said predetermined amount is equal to 360°: n, where "n" is a number equal to the sum of the total number of said bottoms and said perforated walls, so that the larger axes of said bottoms and perforated walls are always angularly displaced from each other about said longitudinal axis of said drum;

milling chambers for comminuted material successively disposed with respect to the direction of the comminuted material feed, where a first of said milling chambers is defined by the internal surface of said first bottom, a peripheral surface of said lined drum and a first surface of said first perforated wall, while a second of said milling chambers is formed by the peripheral surface of said lined drum, a second surface of said first perforated wall and a first surface of said second perforated wall, while a third milling chamber is formed by the peripheral surface of said lined drum, a second surface of said second perforated wall and the internal surface of said second bottom; grinding bodies occupying said milling chambers; a charging port positioned in said first bottom; and a discharging port positioned in said second bottom.

* * * * *